United States Patent [19]

Chan

[11] 3,933,235

[45] Jan. 20, 1976

[54] TYPE INDICATOR

[76] Inventor: Vincent Chan, 84, Waterloo Road, B2, 18th Floor, Kowloon, Hong Kong

[22] Filed: Nov. 12, 1973

[21] Appl. No.: 414,916

[52] U.S. Cl. ..... 197/187; 197/1 A

[51] Int. Cl.[2] ..... B41J 29/42

[58] Field of Search ..... 197/19, 187, 188, 190; 101/45, 110, 109, 111

[56] References Cited

UNITED STATES PATENTS

| | | | |
|---|---|---|---|
| 2,412,777 | 12/1946 | Kao | 197/1 A |
| 2,613,795 | 10/1952 | Yutang | 197/1 A |
| 2,632,548 | 3/1953 | Ackerman | 197/187 X |
| 3,035,680 | 5/1962 | Fondiller | 197/190 |
| 3,743,071 | 7/1973 | Luk | 197/1 |
| 3,783,778 | 1/1974 | Nakada et al. | 101/45 |

*Primary Examiner*—Edgar S. Burr
*Assistant Examiner*—Edward M. Coven

[57] ABSTRACT

A type character visual indicator for an interlingual typewriter for multiple languages typing and having a chassis provided with a window, a drum having type characters is mounted for rotating and sliding to a position to align a selected type character with a striker; the indicator includes an endless band having type characters thereon arranged in reverse direction to the type characters on the drum, to a pointer movable with the drum for indicating a particular type character in a particular row corresponding to the selected type character.

5 Claims, 6 Drawing Figures

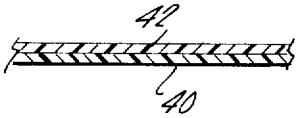
FIG. 5
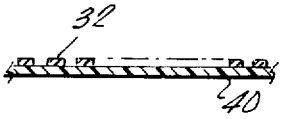
FIG. 4
FIG. 2
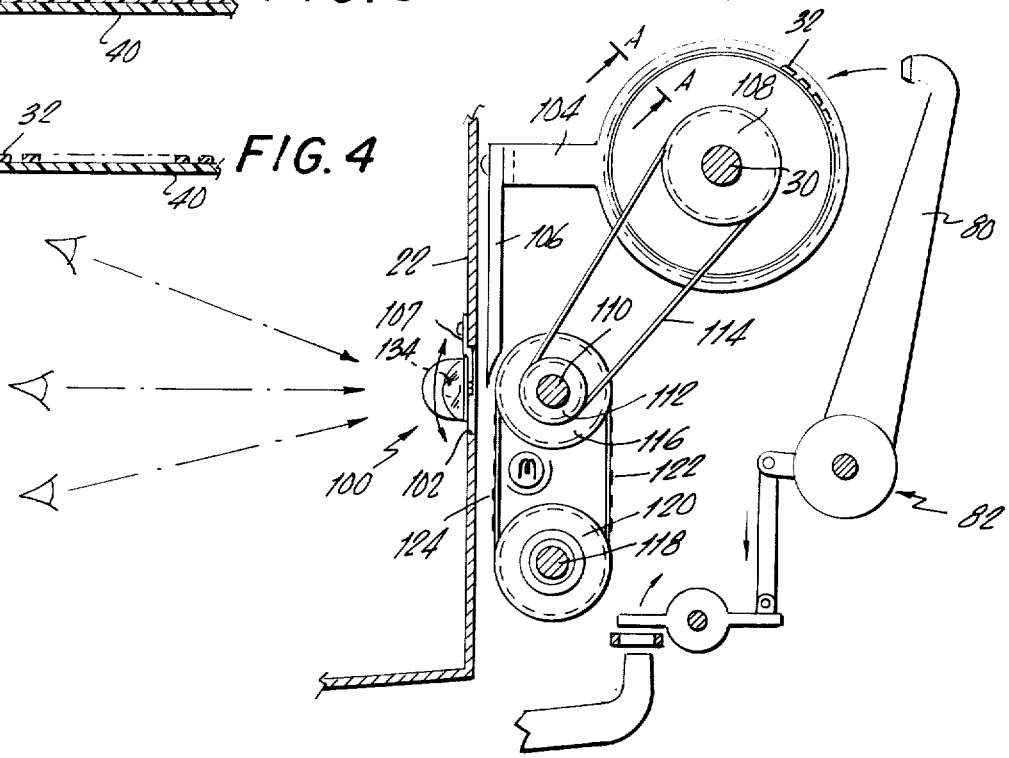
FIG. 3
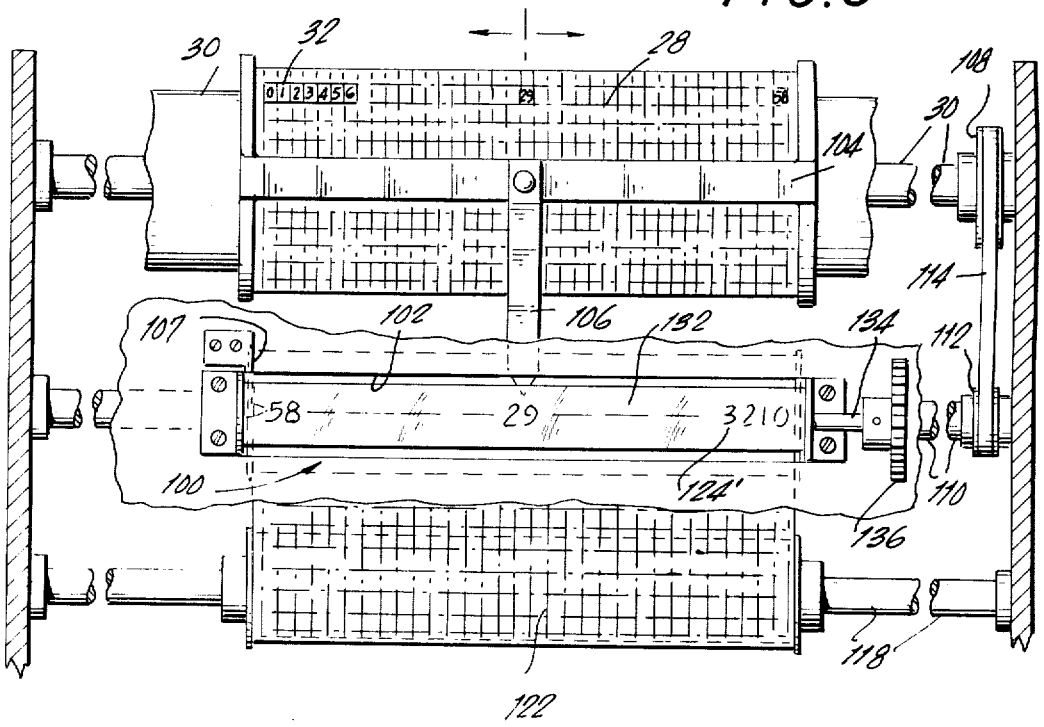

TYPE INDICATOR

BACKGROUND OF THE INVENTION

1. Field of the Invention

This invention relates to typewriters and more particularly to a type character visual indicator for a typewriter capable of being used in typing multiple languages.

2. Description of the Prior Art

In the past, various typewriters have been devised for use in typing Oriental and various other languages, but these typewriters have been either ineffective in operation or have required extensive training and experience in the use thereof. The oriental languages such as Chinese, Japanese, and Korean for the most part require three or four thousand characters. Many of these characters are somewhat similar in appearance and are difficult to see through direct observation of the type characters.

One of the answers to the difficulties heretofor occuring provided a workable and efficient typewriter for use with Oriental languages in particular and useful for all alphabets is disclosed in the application of Man Shan Luk, Ser. No. 241,250, filed Apr. 5, 1972, for INTERLINGUAL TYPEWRITER. This application provides for a typewriter including a platen mounted on a chassis and provided with a drum thereon carrying type characters. One of the type characters is selectively aligned with the striker of the typewriter. This typewriter, however, provides for alphabet and symbol cards to be mounted on the chassis, but does not provide for visual indication of the alignment of the type character drum.

SUMMARY OF THE INVENTION

The present invention overcomes the lack of a type character visual indicator in the earlier multiple typewriters by employing an effective arrangement for visually indicating the alignment of the drum with the striker for providing a representative of the character which is to be struck.

Preferred embodiments of the invention are shown in the drawings, by way of example only, wherein:

BRIEF DESCRIPTION OF THE DRAWINGS

FIG. 2 is a vertical sectional view taken along the planes of line 2—2 in FIG. 1;

FIG. 3 is an elevational view of the indicator;

FIG. 4 is an enlarged sectional detail view showing the type characters;

FIG. 5 is a sectional detail view similar to FIG. 4 showing the material of the type characters prior to etching thereof.

DETAILED DESCRIPTION OF THE PREFERRED EMBODIMENTS

Figure 1:
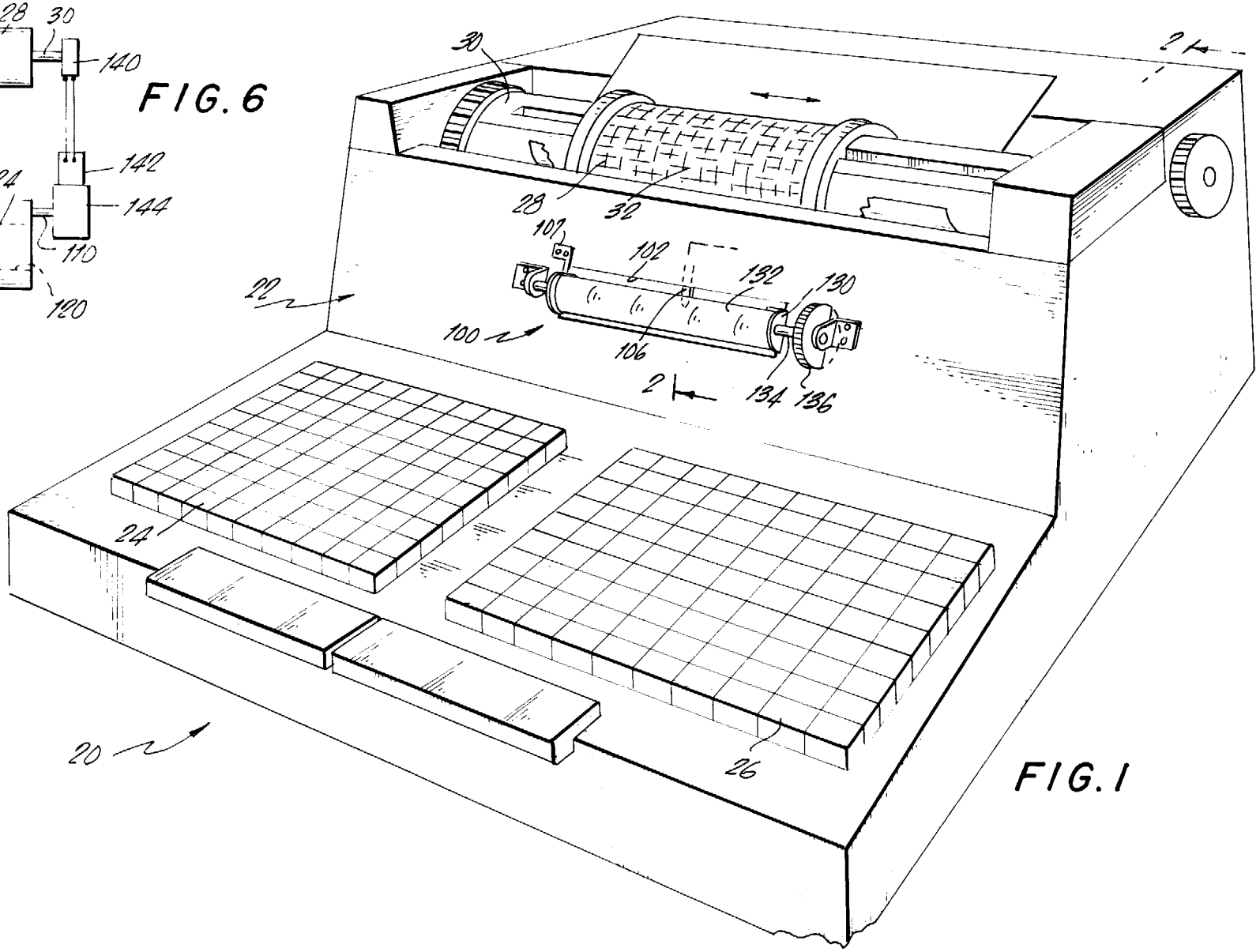
FIG. 1 is a perspective view of an interlingual typewriter illustrating in perspective the visual indicia constructed in accordance with the concepts of the present invention.

With continuing reference to the accompanying drawings wherein like reference numerals designate similar parts throughout the various views, reference numeral 20 generally designates an interlingual typewriter. The typewriter 20 includes a chassis 22 having two keyboards 24 and 26. The keyboard 24 includes keys for rotating a roller 30 and the drum 28 mounted thereon to a predetermined position. The keyboard 26 includes keys for use in longitudinally aligning the drum 28 on the roller 30 by means such as disclosed in the copending application of Man Shan Luk, Ser. No. 241,250, filed Apr. 5, 1972 for INTERLINGUAL TYPEWRITER, now U.S. Pat. No. 3,743,071. The drum 28 has rows of different type characters in the form of letters, numbers or other indicia 32 in any of the alphabets of the various languages of the world or in a suitable combination of these languages.

As shown in FIG. 4, the type characters are mounted on the drum by means of a sheet of plastic 40 which is secured to the drum and which has bonded thereto another sheet of plastic 42 of different material. The type characters are then etched from the sheet of material 42, the sheet 40 preferably being impervious to the etching.

The type characters 32 on the drum 28 are arranged in rows and the mechanism for adjusting the drum is such that a specific type 32 is in alignment with the striker 80 as is shown in FIG. 2. A mechanism generally indicated at 82 is provided for actuating the striker after alignment of a particular type character therewith. As can be readily understood, the type characters are not easily visible and an indicator assembly 100 is provided for allowing the typist to visually observe the character for which the striker 80 is being actuated. In the front wall of the chassis 22 there is provided a window 102. A bracket 104 is attached to the drum 28 and moves along therewith and carries a vertically depending pointer 106 which extends downwardly to alignment with the window 102. A pulley 108 is mounted on the platen 30 and rotates therewith.

A driven shaft 110 has a driven pulley 112 mounted thereon and an endless belt 114 is entrained about the pulleys 108 and 112. The shaft 112 has an enlarged portion 116. An idler shaft 118 is provided and has an enlarged portion 120. An endless band 122 having type characters 124 thereon is entrained about the enlarged portions 116 and 120. It is to be noted that the surface area of the endless band 122 is precisely the same as that of the sheet 40 with type characters 32 thereon so that one complete rotation of the drum 28 will cause a complete passage of the endless band 122. The type characters 124 are arranged in rows spaced in the same manner as the rows of characters 32 but the type characters 124 are arranged in the order right to left as compared with the type characters arranged left to right as can be best seen in FIG. 3.

Suitable brackets 130 are provided for mounting a lens 132 in front of the window 102. The lens 102 may be mounted on a shaft 134 so as to be adjustable through knob 136 whereby the type characters 124 may be magnified as shown at 124', FIG. 3, for better observation thereof. A pointer 107 is provided for use in aligning the lens for facilitating reading of a row of type characters. The lens 132 can be disposed behind or in the opening 102 so that a smooth front surface for the chassis 22 is provided without projections.

Figure 6:
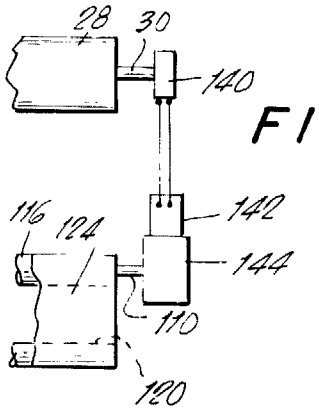
FIG. 6, sheet 1, is a schematic diagram showing a modified arrangement of drive means used in the invention.

As shown in FIG. 6, the platen 30 may have a servo mechanism 140 mounted thereon electrically connected to an amplifier 142 which in turn is connected to a servomotor 144 mounted on the drive shaft 110, whereby an electronic means is substituted for a mechanical mechanism and endless belt shown in FIG. 5.

A latitude of modification, substitution and change is intended in the foregoing disclosure, and in some instances some features of the invention will be employed without a corresponding use of other features.

I claim:

1. A type character visual indicator for an interlingual typewriter having a chassis, a roller having an axis said roller being rotatably mounted on said chassis and a drum having a plurality of rows of type characters arranged thereon in a pre-determined left to right order in alignment with said axis said drum being slidably mounted on said roller for movement along said axis a striker, and means for rotating and sliding said drum to a position to align a selected type character with said striker; said indicator comprising a window in said chassis extending parallel to said axis, an endless band having indicia thereon arranged in rows in reverse order to the type characters on said drum, drive means responsive to rotation of said roller to align the containing row of indicia said selected type on said endless band with said window, and pointer means attached to said drum movable and along said axis with said drum for indicating a particular indicium in said particular row corresponding to said selected type character.

2. An indicator according to claim 1, wherein said drive means comprises a drive pulley on said roller, a driven shaft having a driven pulley thereon, and belt means interconnecting said drive pulley and said driven pulley, said endless band being entrained over said driven shaft.

3. An indicator according to claim 2, including an idler shaft spaced from said driven shaft, said endless band being entrained over said idler shaft.

4. An indicator according to claim 3, wherein said endless band is of a plastic material having plastic type characters forming said indicia bonded thereto.

5. An indicator according to claim 4, wherein said pointer means extends behind and in alignment with said window and in front of said endless band.

* * * * *